United States Patent [19]

Ogino et al.

[11] Patent Number: 4,573,428

[45] Date of Patent: Mar. 4, 1986

[54] RELEASE AGENT APPLICATOR FOR USE WITH COPYING MACHINE

[75] Inventors: Takao Ogino; Hiroo Katsuya; Chiaki Kato; Itsuro Kato; Tsutomu Kato, all of Osaka, Japan

[73] Assignees: Sumitomo Electric Industries, Ltd.; Sharp Kabushiki Kaisha, both of Osaka, Japan

[21] Appl. No.: 610,747

[22] Filed: May 16, 1984

[30] Foreign Application Priority Data

May 19, 1983 [JP] Japan ..... 58-88942

[51] Int. Cl.[4] ..... B05C 11/105

[52] U.S. Cl. ..... 118/60; 118/260; 118/264; 432/60

[58] Field of Search ..... 118/264, 260, 60, 70, 118/101; 355/3 FU; 219/216; 432/60

[56] References Cited

U.S. PATENT DOCUMENTS 4,359,963 11/1982 Saito et al. ..... 118/260

4,375,201 3/1983 Kato ..... 118/60

*Primary Examiner*—John P. McIntosh

*Attorney, Agent, or Firm*—Staas & Halsey

[57] ABSTRACT

An improved release agent applicator for use with a copying machine in which a porous polyethylene tetrafluoride resin tube is installed in a support with the part of the tube which forms an outlet for the release agent contained in the tube projecting from an opening in the support. The outer surface of the porous tube is covered with a film of a polymer having a low melting point, such as polyethylene. When the applicator is installed, the normal heating of the fixing roll causes the polymer film to melt, opening the applicator for use. Accordingly, leakage from the applicator prior to use is prevented.

13 Claims, 7 Drawing Figures

RELEASE AGENT APPLICATOR FOR USE WITH COPYING MACHINE

BACKGROUND OF THE INVENTION

The present invention relates to an apparatus for applying a release agent, such as silicone oil, to the fixing roll of a plain paper copying (PPC) machine.

In the conventional fixing mechanism for a PPC machine, the toner pattern transferred to copy paper is fixed to the copy paper by passing the copy paper between a heated fixing roll and an elastic pressure roll such as a rubber roll. Unfortunately, while the paper with the toner pattern is passing between the heated fixing roll and the elastic pressure roll, the paper has a tendency to stick to both of the two rolls, causing various problems such as incomplete fixing, a double image due to the adherence of toner particles to the fixing roll rather than the copy paper (this phenomenon is generally referred to as "offsetting"), and malfunction of the copying machine.

While various methods have been proposed for solving these problems, the most usual method is to apply a release agent to the fixing roll and elastic roll. However, applying a uniform coating of the release agent in the correct amount is very difficult. If the amount of the release agent is excessive, the paper may be stained. Furthermore, too rapid a consumption of the release agent requires frequent application of the agent, and if excessive amounts of the agent are present, it will solidify on the roll surface and cause problems with the copying process. If the amount of the release agent is too small, offsetting will unavoidably occur, or the resulting poor releasability from the roll surface will cause the paper to stick to the roll. Commonly used release agents are heat-resistant oils such as silicone oil.

To eliminate these defects, various release agent applicators have been proposed, but none has proved to be completely satisfactory.

The applicant previously invented a release agent applicator. The applicator of that invention assures uniform application of the release agent, requires a minimum consumption of the agent, and can be installed in a very small area. Furthermore, the applicator has a simple configuration, is very inexpensive, and can be thrown away after use.

As shown in FIGS. 1A, 1B and 2, the fixing apparatus of that invention basically consists of a fixing roll 14 and a pressure roll 15, between which the toner image is passed to be fused onto a copy paper 16. This apparatus is characterized in that a porous polyethylene tetrafluoride resin tube 7 having both ends closed is brought into contact with the fixing roll 14 in its axial direction. A release agent 6 contained in that porous resin tube oozes out through pores of the tube to apply a thin coating of the release agent onto the roll.

Since the porous tube 7 is soft, it is carried on a support 1 (FIGS. 1A and 1B) or 4 (FIG. 2). All pores of the porous tube except those in the area which acts as an outlet for the release agent are closed with fluorine rubber or another suitable material. This is done for the purpose of discharging a predetermined and uniform amount of the release agent. The porous tube 7 may be filled with the release agent 6 before the tube is nested in the support. The applicator used for the filling operation can be thrown away after use. Alternatively, the tube may be filled with the release agent through an inlet 5 after the tube is accommodated in the support.

In FIGS. 1A, 1B and 2, reference numeral 2 represents the area of the porous polyethylene tetrafluoride resin tube where the pores are closed, and 3 refers to that area of the porous polyethylene tetrafluoride resin tube where the pores are left open.

However, this apparatus is still defective in that it takes a significant amount of time to close the pores in the area of the porous tube other than that through which the release agent is to ooze out. The present inventors later invented an improved device to remedy this drawback. As shown in FIGS. 3A and 3B, that release agent applicator includes a divided-type support 21 having an opening 23 whose width A is smaller than the maximum width B of a cavity 22. The two members of the support are joined to seal both ends of a porous polyethylene tetrafluoride resin tube 20 which is or will be filled with a release agent 6 and the major portion of which is accommodated in the cavity 22, allowing the remainder to project from the opening 23 to provide a release agent outlet. The pores in that part of the porous tube other than where the release agent oozing outlet projects from the opening are closed due to a contact force between the porous tube 20 and the corresponding wall of the cavity in the support 21.

As stated above, this device exhibits excellent performance as a release agent applicator, and a device prefilled with the release agent can be thrown away after use. However, even this applicator has one problem, that is, spillage of the release agent from the outlet during the transportation of the applicator prior to its use.

SUMMARY OF THE INVENTION

The present invention has been accomplished to eliminate the above-mentioned problem.

Specifically, the invention provides a release agent applicator for use with a copying machine in which a porous polyethylene tetrafluoride resin tube is installed in a support with a part of the tube which forms an outlet for the release agent contained in the tube projecting from an opening in the support. Both ends of the tube are sealed. In accordance with the invention, the outer surface of the porous tube is covered with a tubular form of a film of a polymer having a low melting point, such as polyethylene.

BRIEF DESCRIPTION OF THE DRAWINGS

FIGS. 1A, 1B, 2, 3A and 3B illustrate two release agent applicators developed by the present inventors before accomplishing the present invention, of which FIG. 1A shows a front view of one of these, FIG. 1B a cross section, FIG. 2 also a front view, FIG. 3A a plan view of the other applicator, and FIG. 3B a cross section of the other applicator.

DESCRIPTION OF THE PREFERRED EMBODIMENTS

Figure 4:
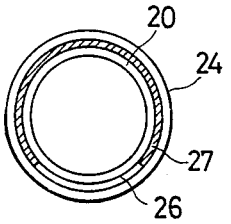
FIGS. 4 and 5 are cross-sectional views showing the release agent applicator of the present invention.
Figure 5:
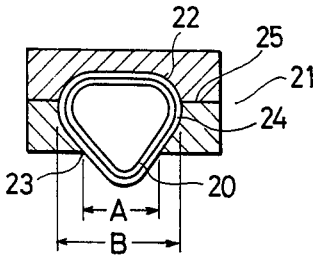

As shown in FIGS. 4 and 5, the release agent applicator according to the invention is essentially the same as the previous type of our own invention except that the entire outer periphery of the porous polyethylene tetrafluoride resin tube 20 is covered with a tubular form 24 of a film of a polymer having a low melting point such as polyethylene. The tubular form 24 of the polymer film has both ends sealed before or simultaneously with the installation of the porous tube in the support.

Figure 1A:
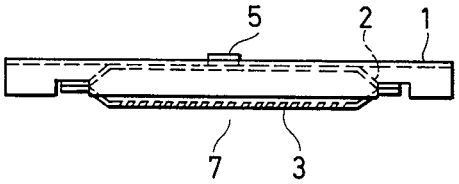
FIG. 1A (PRIOR ART)
Figure 1B:
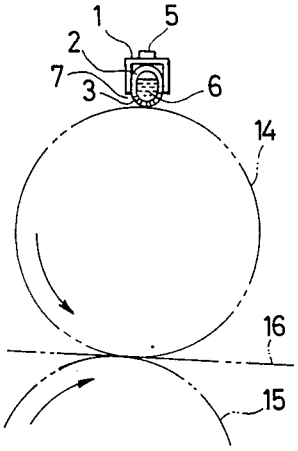
FIG. 1B (PRIOR ART)
Figure 2:
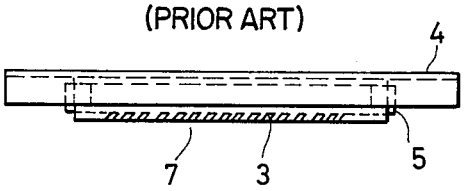
FIG. 2 (PRIOR ART)
Figure 3A:
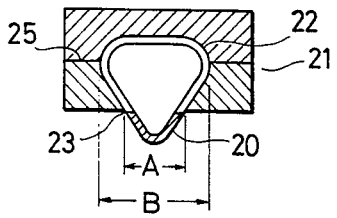
Figure 3B:
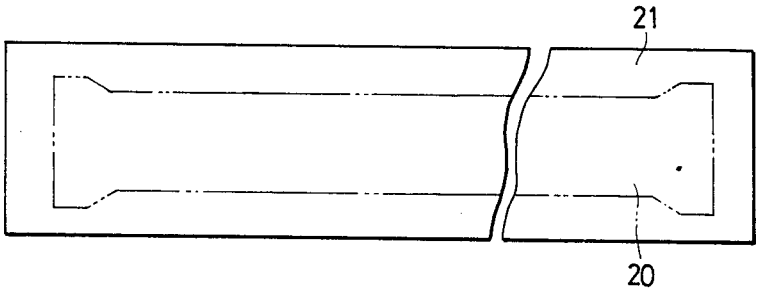

In FIGS. 4 and 5, like reference numerals as those used in FIGS. 1 to 3 identify like components. Further, reference numeral 20 indicates a porous polyethylene tetrafluoride resin tube which is produced by extruding a polyethylene tetrafluoride resin mix containing a liquid lubricant into a tubular form, drawing the tube, and sintering the same. Examples of this tube are shown in Japanese Patent Publication No. 13560/67 and Japanese Patent Application No. 155226/75 and have the following features: fine pores of a uniformly controlled size, preferably in the range of 0.1 to 0 μm; a porosity of 50 to 85%; an outside diameter of 5 to 50 mm; and a wall thickness of 0.1 to 5 mm. A commercial product having these dimensions is available from Sumitomo Electric Industries, Ltd. of Japan under the trade name ∓Porefuron ™". In FIG. 4, the pores in that area of the porous tube 20 other than the outlet 26 for the release agent are closed with fluorine rubber or any other suitable material 27 (see, for example, Japanese Laid-Open Patent Application No. 24175/83).

Reference numeral 24 represents the tubular form of a polymer film having a low melting point such as polyethylene. This tubular form covers the entire outer periphery of the porous polyethylene tetrafluoride resin tube. The melting point of the polymer film may be such that the film melts away when the fixing roll is heated to the operating temperature of the copying machine (usually 160° to 200° C.).

According to the present invention described above, since the porous tube is covered with a polymer film, no spillage of the release agent will occur before the use of the applicator, and during its use, the film is automatically removed by being melted away due to the normal heating of the fixing roll.

Furthermore, because the entire outer periphery of the porous tube is covered with the tubular form of the polymer film, no seam line is formed on the porous tube. Therefore, there is no possibility of spillage or leakage of the release agent.

As already mentioned, the time of filling the porous tube with the release agent is not critical for the purposes of the present invention. The tube may be filled with the release agent before the former is accommodated in the support, or alternatively, the release agent may be introduced into the tube through an inlet after the support members are joined to accommodate the tube. The former case is preferred for providing a disposable applicator.

We claim:

1. In a release agent applicator for use with a copying machine having a heated fixing roller and compression roller assembly for fixing a toner image to a toner image bearing material, a porous polyethylene tetrafluoride resin tube installed in a support in such a manner that a part of the tube which forms an outlet for a release agent contained in the tube projects from an opening in the support to the heated fixing and compression roller assembly, said porous tube having both ends sealed, wherein the improvement comprises: a tubular form of a polymer film temporarily sealingly covering at least the entire outer surface of said release agent outlet of said porous tube to prevent leakage of the release agent contained in said porous tube through said outlet and having a melting point of less than 200° C. for removal of said polymer film covering at least said outlet after installation of said porous tube in said support.

2. The release agent applicator according to claim 1, wherein said polymer is polyethylene.

3. The release agent applicator according to claim 1, wherein pores areas of the porous tube other than an outlet area for the release agent are closed.

4. The release agent applicator according to claim 3, wherein the closed pores are closed with fluorine rubber.

5. The release agent applicator according to claim 1, wherein the closed pores are closed by contact with said support.

6. The release agent applicator according to claim 1, wherein said polymer film has a melting point less than the operating temperature of the copying machine and is removed by being melted away due to normal heating of the roller assembly.

7. A release agent applicator for use with a copying machine having a heated fixing roller and compression roller assembly for fixing a toner image to a toner image bearing material, the applicator comprising:

(a) a release agent;

(b) a porous tube for containing the release agent, the porous tube being installed in a support in the copying machine in such a manner that a part of said porous tube forms an outlet projecting from an opening in the support for the release agent contained in said porous tube and having both ends sealed; and (c) a tubular form of a polymer film for temporarily sealingly covering at least the entire outer surface of said release agent outlet of said porous tube to prevent leakage of the release agent contained in said porous tube through said outlet and having a melting point of less than 200° C. for removal of said polymer film covering at least said outlet after installation of said porous tube in said support.

8. The release agent applicator of claim 7, wherein the porous tube is a porous polyethylene tetrafluoride resin tube.

9. The release agent applicator according to claim 7, wherein said polymer film has a melting temperature less than the operating temperature of the copying machine and is removed by being melted away due to normal heating of the roller assembly.

10. The release agent applicator according to claim 9, wherein said polymer is polyethylene.

11. The release agent applicator according to claim 9, wherein pore areas of the porous tube other than said outlet for the release agent are closed.

12. The release agent applicator according to claim 11, wherein the closed pores are closed with fluorine rubber.

13. The release agent applicator according to claim 9, wherein the closed pores are closed by contact with said support.

* * * * *